United States Patent [19]

Cox

[11] Patent Number: 4,911,613

[45] Date of Patent: Mar. 27, 1990

[54] HYDRAULIC RAM-TYPE WATER PUMP

[75] Inventor: Larry A. Cox, c/o Pueste De Sol Mazatlan, Sinaloa, Mexico

[73] Assignees: Larry A. Cox; Louis B. Garcia, both of Carmichael, Calif.

[21] Appl. No.: 261,360

[22] Filed: Oct. 24, 1988

[51] Int. Cl.[4] ..... F04F 7/02

[52] U.S. Cl. ..... 417/226

[58] Field of Search ..... 417/225, 226, 227

[56] References Cited

U.S. PATENT DOCUMENTS

| | | | |
|---|---|---|---|
| 422,936 | 3/1890 | Hanson | 417/226 X |
| 715,167 | 12/1902 | Snavely | 417/226 |
| 753,560 | 3/1904 | Earle et al. | 417/226 |
| 992,524 | 5/1911 | Walters | 417/226 |
| 1,016,409 | 2/1912 | Hill et al. | 417/226 |
| 1,148,982 | 8/1915 | Nicholas | 417/226 |
| 2,309,058 | 1/1943 | Francfort | 417/226 |

FOREIGN PATENT DOCUMENTS

| | | | |
|---|---|---|---|
| 151840 | 8/1937 | Fed. Rep. of Germany | 417/226 |
| 424066 | 2/1935 | United Kingdom | 417/226 |

OTHER PUBLICATIONS

Skookum Columbia Hydraulic Rams.

*Primary Examiner*—Leonard E. Smith
*Assistant Examiner*—Eugene L. Szczecina, Jr.
*Attorney, Agent, or Firm*—Mark C. Jacobs

[57] ABSTRACT

A motorless water pump for utilizing the rate of flow of falling water to pump the same to a higher location. The pump utilizes a phenomenon known as "water hammer" to use the force of the running water to close a valve and pump the water to a higher location. The pump is economical, portable and contains relatively few moving internal parts.

7 Claims, 4 Drawing Sheets

HYDRAULIC RAM-TYPE WATER PUMP

BACKGROUND OF THE INVENTION

1. Field of the Invention

The invention relates to water pumps; and, more particularly, to a motorless water pump using the force of running water to pump the same to a higher location.

2. Description of the Prior Art

Motorless water pumps are known for using the force of flowing water to pump the same to a higher location. One such pump is manufactured by the Skookum Co., Inc., Portland, Oreg., under the name "Skookum-Columbia Hydraulic Ram". This pump uses a waste valve to close off water flow through a pipe outlet to a higher location. The incoming water overcomes the tension on the spring of the waste valve closing the pipe outlet and creating a water hammer effect. This instantaneous pressure of great thrust forces a spring biased valve, normally closing off an air dome, to open admitting water and air to the dome. This relieves pressure on the waste valve which again opens automatically closing the discharge valve and repeating the process. The Skookum pump uses a large number of parts in the valving areas and such parts may clog or become otherwise inoperative or inefficient in use. There is a need for a pump utilizing the water hammer effect using fewer parts and that is more efficient and economical than prior art pumps.

SUMMARY OF THE INVENTION

It is an object of this invention to provide an improved motorless water pump.

it is a further object of this invention to provide a motorless water pump utilizing water flow and fall thereof to pump water to a higher location.

It is still further an object of this invention to provide such a pump which is economical and uses few internal moving parts.

These and other objects are preferably accomplished by providing a motorless water pump having a floating light-weight ball which seals a valve seat leading into a water outlet, a water inlet leading into the housing having the ball therein and a second water outlet that is spring valve controlled leading to an air dome whereby incoming water moves the ball to close off the first outlet creating a water hammer effect opening up the valve at the second outlet and thereby pumping water out of the first water outlet to a higher location.

DESCRIPTION OF THE PREFERRED EMBODIMENT

Figure 1:
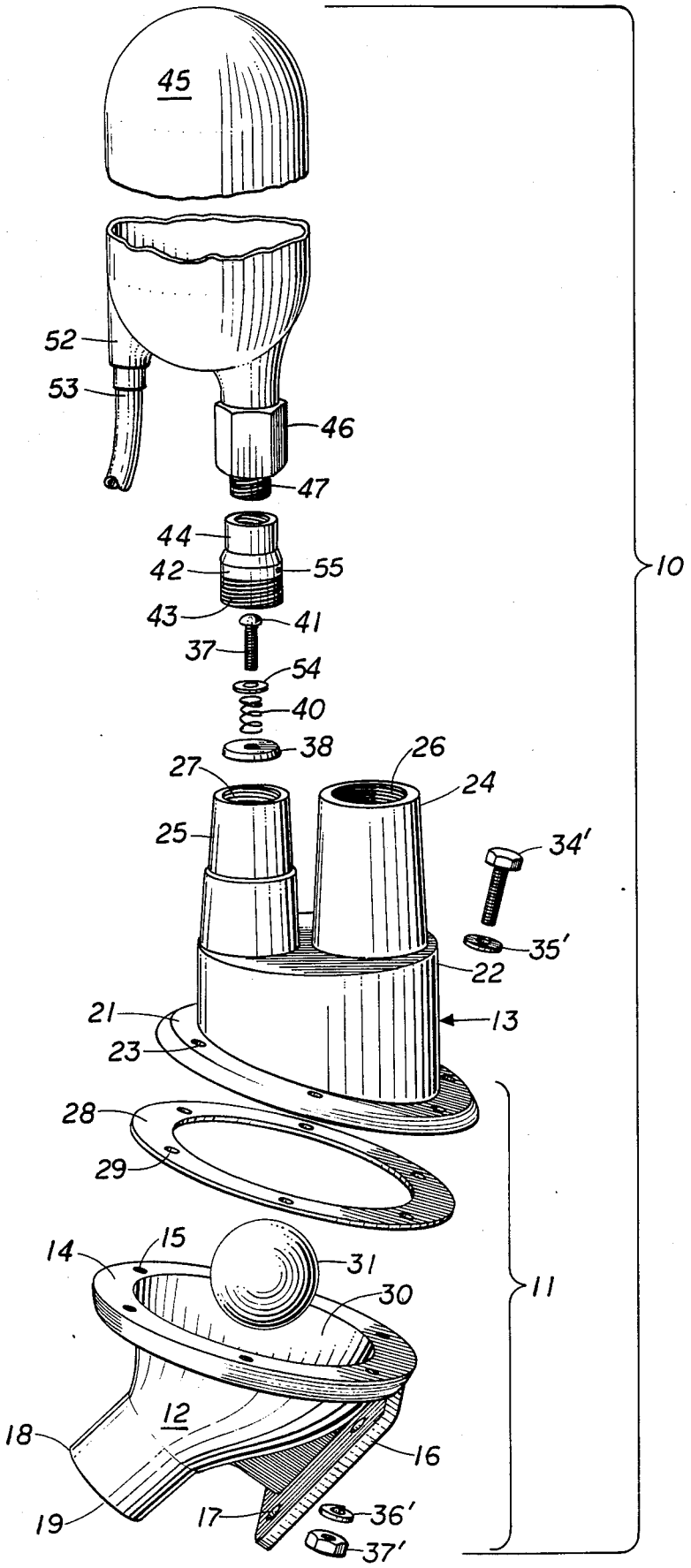
FIG. 1 is an exploded view of a pump in accordance with the teachings of the invention.
Figure 3:
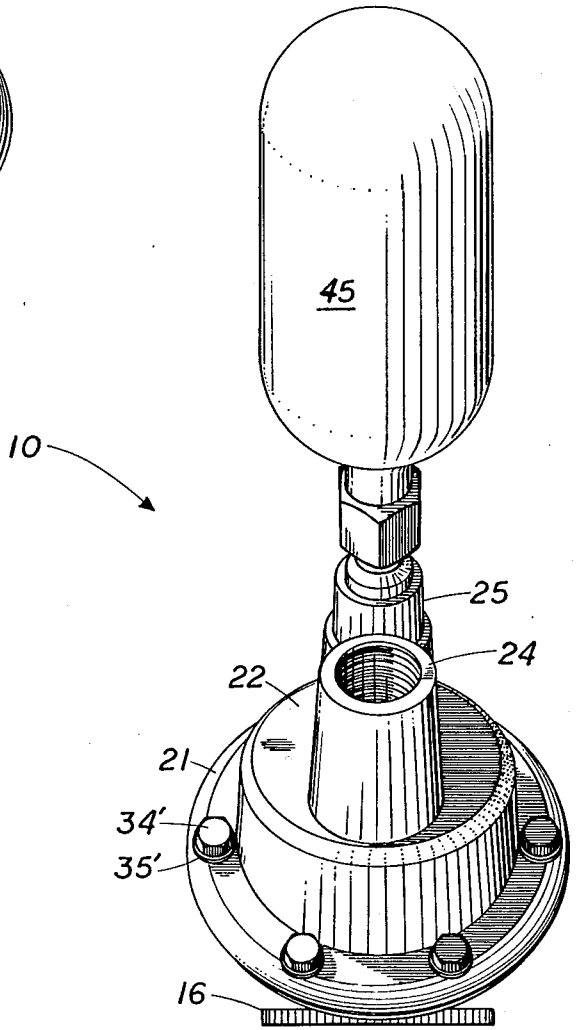
FIG. 3 is an outlet end view of an assembled view of the pump of FIG. 1.
Figure 2:
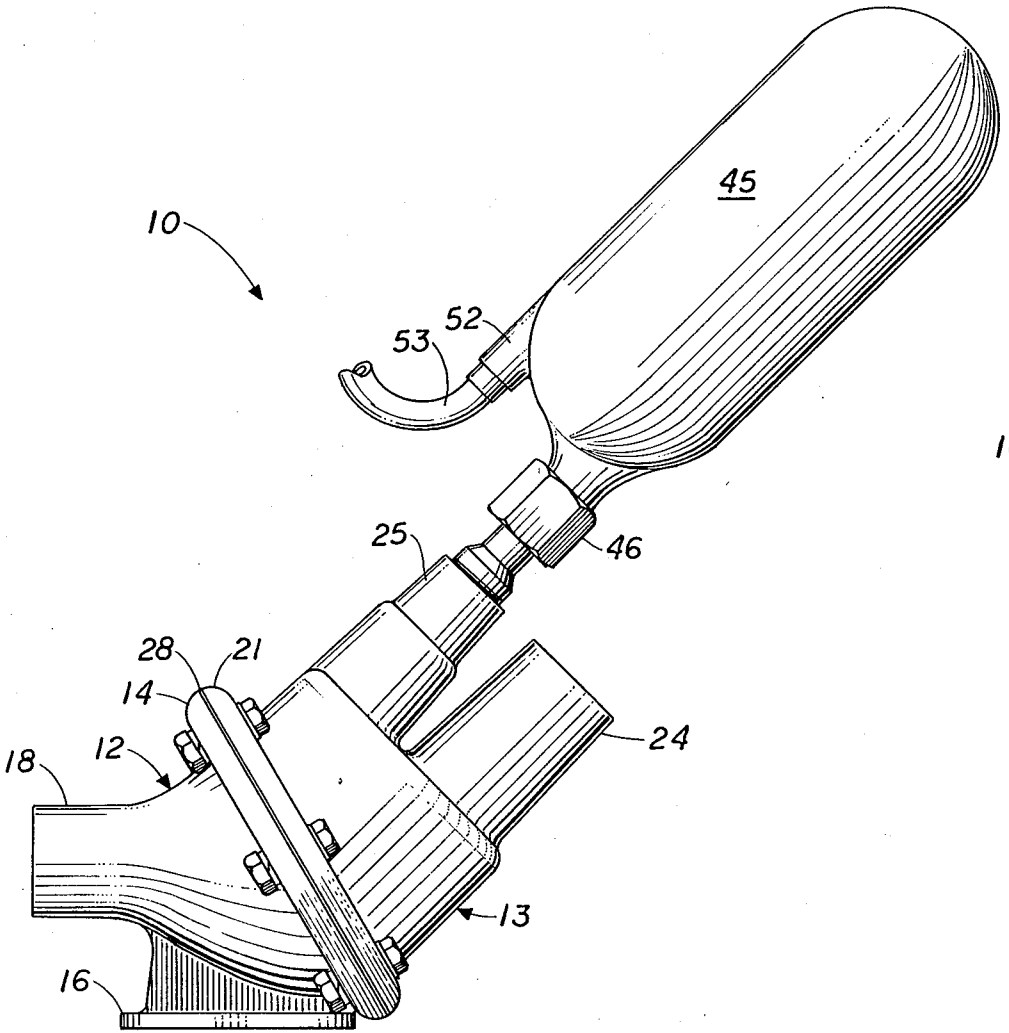
FIGS. 2 is a side view of an assembled view of the pump of FIG. 1.

Referring now to FIG. 1 of the drawing, a pump 10 is shown having a main housing 11 comprised of a pair of mating flanged sections 12, 13. Flanged section 12 has an apertured flange plate 14, generally circular, with a plurality of spaced apertures 15 and an integral mounting plate 16. Plate 16 may also have one or more apertures 17 and, as seen in FIG. 2, is at an angle with respect to the plane of plate 14. A water inlet or drive pipe 18 having a threaded inlet 19 (FIGS. 3 and 4) is provided integral with flange plate 14 and may have a boss 20 (see particularly FIG. 3) surrounding pipe 18 also an integral part of plates 14, 16 and pipe 18. As seen in FIG. 2, preferably the central longitudinal axis of pipe 18 is parallel to the plane of flange plate 16. Also, as seen in FIG. 1 the inlet 19 of pipe 18 opens into the interior of flanged section 12.

Figure 4:
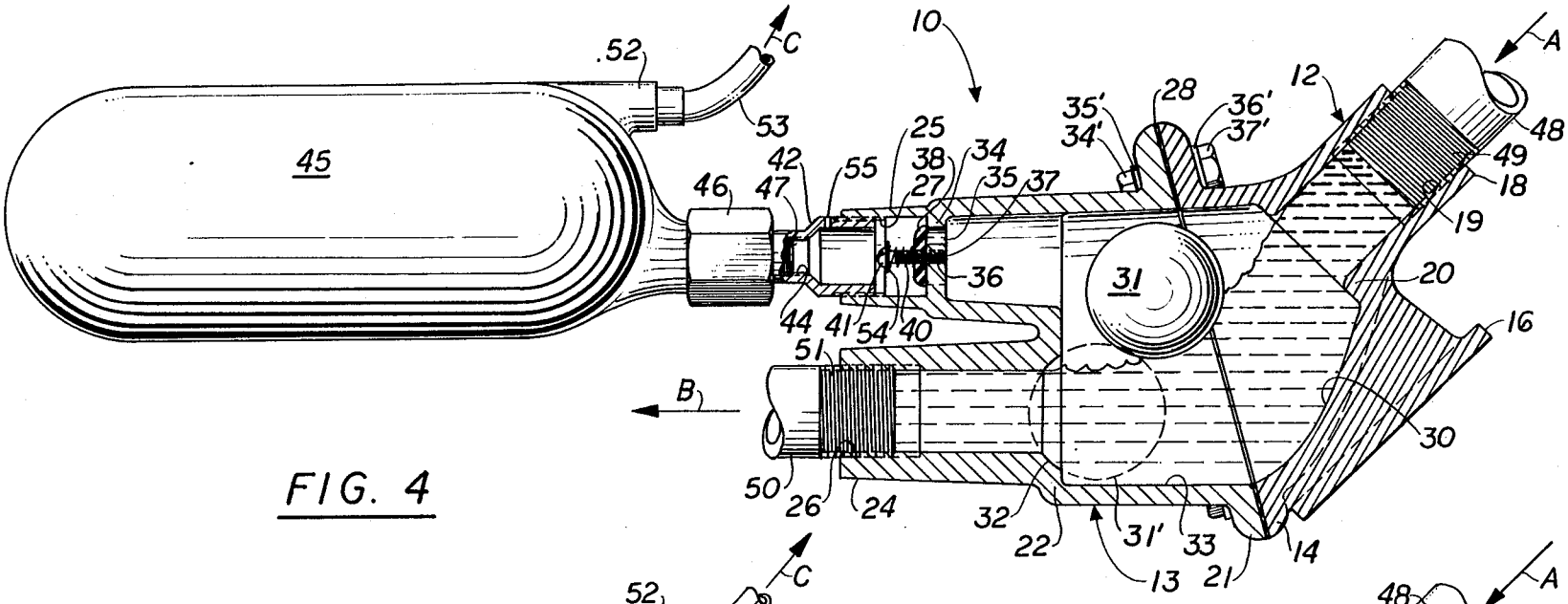
FIG. 4 is a sectional view of the pump of FIGS. 1 to 3.

Flanged section 13 is also comprised of a generally circular flange plate 21 and an integral boss 22. Plate 21 has a plurality of spaced apertures 23 which are aligned with apertures 15 in flanged section 12 when sections 12 and 13 are assembled. A pair of spaced outlets 24 and 25 are provided on section 13 integral with boss 22 having threaded throughbores 26, 27, respectively, fluidly communicating with the interior of section 13. As seen in FIG. 1, outlet 24 is longer than outlet 25. As seen in FIG. 4, a seat 32 is also provided on the interior wall 33 of flanged section 13 communicating with the throughbore 26 of outlet 24. Seat 32 also conforms to the configuration of ball 31. A plurality of bolts 34', spring washers 35', plain washer 36' and nuts 37' (only one set shown in FIG. 1 for convenience of illustration) are provided for insertion into aligned apertures 23, 29 and 15 for securing flanged sections 12, 13 and gasket 28, the assembled pump 10 being shown in FIGS. 2 to 4. Note small hole 55 in section 13, see infra.

A generally circular gasket 28 of any suitable material is provided between flange plates 21 and 14. A plurality of spaced apertures 29 are provided in gasket 28 aligned with aperture 23 and 15 so that, when assembled, gasket 28 is sandwiched between plates 21 and 14 thus preventing leakage. Thus, gasket 29 may be any suitable gasket material, such as rubber, cork, etc.

As seen in FIG. 1, the interior 30 of flanged section 12 surrounding inlet 19 is stepped and provides a seat for a preferably lightweight hollow ball 31, which may be of plastic or any other suitable material, and of a size to seat against seat 32 thereby blocking outlet 24 and closing off the same.

Looking at FIG. 4, the outlet to throughbore 27 is partially closed off by a partition wall 34 having a semi-annular opening 35 therethrough and a threaded aperture 36 receiving therein a threaded screw 37. A resilient bell-shaped valve member 38 is provided in outlet 25 covering semi-annular opening 35 and retained thereto by screw 37 passing therethrough. A spring 40 surrounds the shaft of screw 37 between the head of the screw 41, (which head is preferably slotted for adjustment), and valve member 38. A washer 54 is provided (see FIG. 1) between screw head 41 and spring 40. It is to be understood that pressure of water acting on the underside of valve member 38 moves valve member 38 against the bias of spring 40 to the position shown in FIG. 5 uncovering the opening 35 as will be discussed further hereinbelow.

Outlet 25 is closed off by a valve housing 42 mated at its lower threaded end 43 to threaded throughbore 27 terminating at top in a reduced internally threaded neck 44. Neck 44 is adapted to be threaded to a water delivery pipe for delivering water from pump 10 to a higher location. Also, housing 42 can be removed for access to screw 37 for adjusting spring pressure of the same.

Drive pipe inlet 19 is threaded for connection to a drive pipe for supplying water to pump 10 from a higher location.

An air dome 45 is provided having an elongated generally cylindrical configuration (FIGS. 1 and 2) with an integral nut portion 46 and a hollow threaded end 47 for mating with neck 44. Optionally, a drain plug, such as a threaded screw screwed into the neck portion 52 of dome 45 may be provided for draining the water therefrom if element 53 is not employed for its intended purpose.

Figure 5:
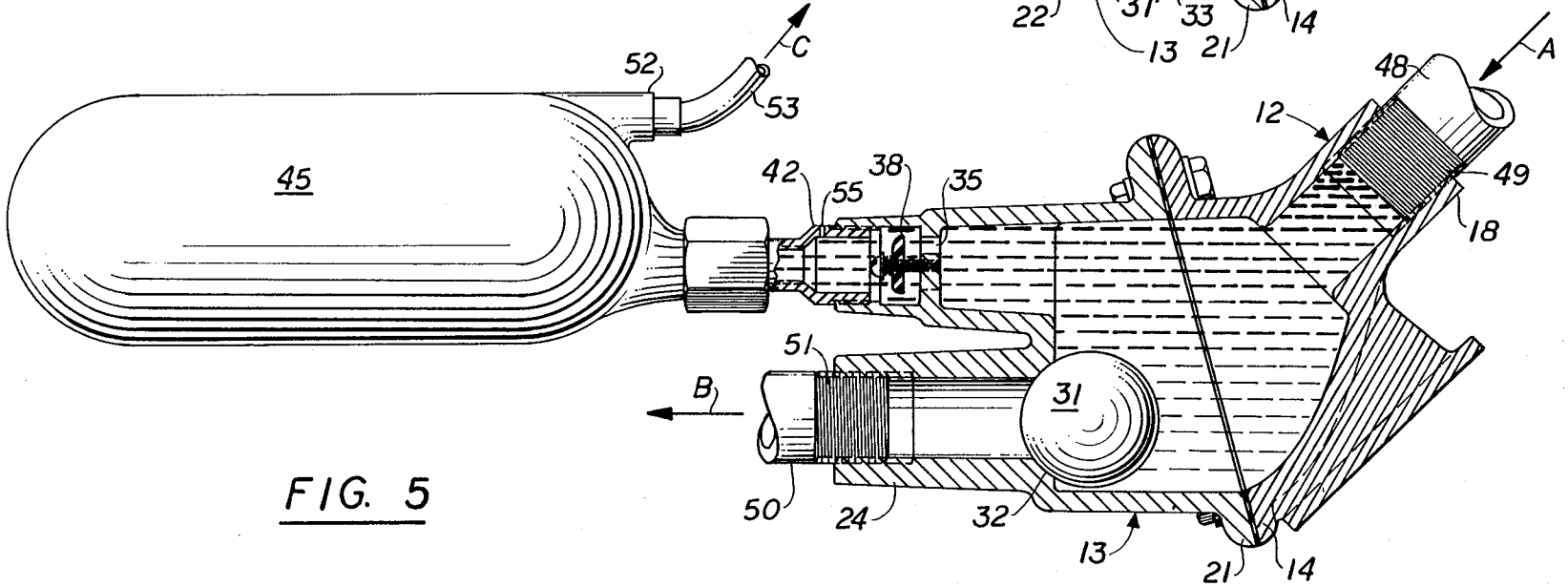
FIG. 5 is a view similar to FIG. 4 showing another position of the ball valve.
Figure 6:
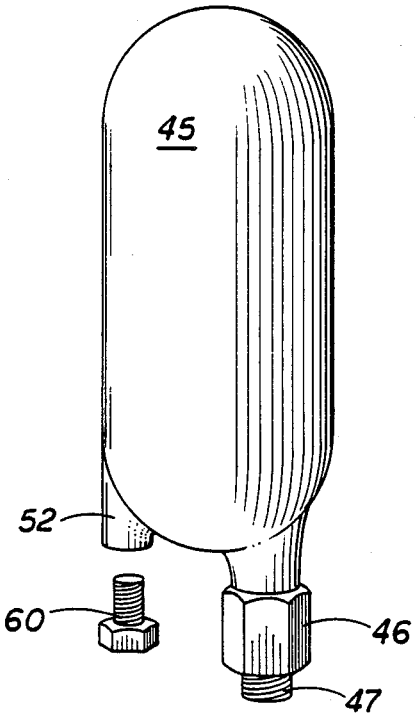

Pump 10 is assembled as shown in FIGS. 4 and 5 and as heretofore discussed, by coupling of dome 45 to neck 44, nut portion 46 being used to tighten the same. Drive pipe 48 (FIGS. 4 and 5), having a threaded end 49, coupled to a source of running water (arrow A), is threaded to water inlet 18. Outlet pipe 50, having threaded end 51, is coupled to throughbore outlet 26.

The water (arrow A) delivered through pipe 48 enters pump 10 from the source thereof through a head or fall into inlet 18 and must have a predetermined minimum flow rate.

Thus, any stream of water providing a minimum rate of flow may be used to power pump 10. The greater the gallons of water flowing per minute through the drive mechanism (exiting the pump in direction of arrow 3), the larger capacity pump that can be used and the higher the water exiting outlet 53 (arrow C) can be pumped. Obviously, the size and capacity of pump 10 is chosen depending on the amount of water available, its flow rate, and the amount of water desired to be pumped to a reservoir or other higher location.

In any event, the water arrow A enters pump 10 through drive pipe 18. The speed of the incoming water passes by ball 31 (FIG. 4), which is buoyant and floating, striking the lower half thereof forcing ball 31 to cover the seat 32 surrounding the opening into outlet 24 as seen by ball 31' in dashed lines in FIG. 4. This causes an abrupt stop to the flow of the water resulting in a phenomenon known as the "water hammer" effect in the art.

This "water hammer" effect is an instantaneous pressure of great thrust which forces the discharge valve 38 to open (FIG. 5) admitting water through housing 42 to dome 45, squirting into the hollow interior of reservoir 45. This lifts water through the small outlet pipe 53 see arrow C as high as 30 times greater than the head or fall of water from the source thereof through pipe 48 into drive pipe 18. The opening of valve 38 simultaneously allows water to be pumped entering dome 45 for storage and use and relieves pressure on ball 31. This allows ball 31 to return to the floating position shown in solid lines in FIG. 4, at the upper portion of the interior of pump the water now flows through the drive outlet (arrow B), then repeating the foregoing process in a continuous action. The air pressure in dome 45 absorbs the spurting action of the water injection and smooths out the flow of water through pipe 53.

The pump 10 is completely independent of electricity, gasoline or other external power source and uses the force of flowing water to pump gallons of water efficiently and continuously with little cost. The invention herein can be used for irrigation, watering livestock, camping, municipal water supply, mills, etc; where ever-running water exists and a fall of such water can be utilized. No wells need be dug or driven and no pump motors that can fail are used.

As discussed, pump 10 must be located below the water source and a minimum vertical fall of water (such as 2 feet) through drive pipe 18, is needed. Suitable valves (not shown) may be used on pipes 48 and 50 to control the water flow when operation is not desired. Any suitable materials, such as metals, plastics, fiberglass, rubber where applicable, may be used. Obviously a plurality of pumps such as pump 10 may be used and the air dome can be of any desired size and internal capacity.

The pump herein is portable and lightweight, as for example, 10 to 15 pounds for a 2" diameter pump, and is merely placed on the ground and held in position in any suitable manner. Drive pipe 48 can be of any suitable diameter; reduction connections can be used. The air dome 45 acts as a pressure tank to force the output water through pipe 53 to a higher level. Typically dome 45 measures 2"×8". Although I have disclosed a specific embodiment of the invention, variations thereof may occur to an artisan and the invention is to be limited only by the scope of the appended claims.

OPERATION

As noted earlier, this pump includes a small hole 55 in section 13. Its use will now be discussed. When the ball is in the down or pump position 31', the hole shoots a small stream of water into the air under the effect of water hammer, and when the ball moves back to the floating or charging position 31, a bubble of air is drawn into the pump. The bubble of air keeps the dome full of air down to the outlet line.

When water enters the dome under such instantaneous pressure from the water hammer effect it emulsifies the air admitted through hole 55 with the water and pumps it out of the dome creating a partial vacuum that pulls in outside air through hole 55 to neutralize that vacuum.

I claim:

1. A motorless water pump adapted to utilize the water hammer effect to transfer running water to a higher location comprising:

a main pump housing;

a fluid inlet opening into one end of the interior of said housing;

a pair of generally parallel spaced fluid outlets communicating with the interior of said housing at a location higher from said fluid inlet a said interior being stepped and providing a seat for a ball;

a valve seat leading into the first of said outlets;

a spring biased valve closing off the second, i.e the other of said outlets;

an air dome connected to the said other of said outlets, said air dome having an internal reservoir in fluid communication with the interior of said housing and having an outlet; and a lightweight floating ball disposed in the interior of said pump having a configuration conforming to said valve seat whereby, running water entering said inlet flows out of said one of said outlets, said ball is moved into engagement with and conforms to said valve seat causing an abrupt stop to the flow of incoming water thereby creating a water hammer effect resulting in an instantaneous pressure of water thrust forcing said spring biased valve to open to pump water out the second of said outlets and into the interior of said dome.

2. In the pump of claim 1 wherein said pump housing is comprised of two mating parts, with a resilient gasket disposed at the junction of said parts.

3. In the pump of claim 1 wherein said valve is a resilient member normally closing off said restricted opening, said valve including a screw threaded into a threaded opening adjacent said restricted opening having a slotted enlarged head thereon, said resilient member slidably mounted on said screw between said head and said restricted opening, and a spring encircling said screw disposed between said head and said resilient member for normally biasing said resilient member into a position closing off said restricted opening.

4. In the pump of claim 1 wherein the other of said outlets includes a terminal threaded end, a valve housing having a first diameter portion threadably engaging said threaded end and a second threaded diameter portion of an inner diameter less than the inner diameter of said first diameter portion located higher than said first diameter portion.

5. In the pump of claim 1 wherein said ball is a hollow rubber ball.

6. In the pump of claim 1 wherein said pump housing has an integral base plate having a planar surface lying in a generally horizontal plane, the longitudinal axis through the center of said inlet being at an angle corresponding with the plane of said planar surface.

7. In the pump of claim 1 wherein said air dome has a removable plug coupled to a neck portion fluidly communicating with the interior of said air dome for draining water therefrom.

* * * * *